United States Patent [19]

Kenyon, Jr.

[11] Patent Number: 4,964,548

[45] Date of Patent: Oct. 23, 1990

[54] DISPENSING CLOSURE HAVING AN INTERIOR SEALING SLEEVE, A THREADED SLEEVE ENGAGING A THREADED TUBE, AND STOP BLOCKS LIMITING TWISTING OF THE CLOSURE CAP

[75] Inventor: William B. Kenyon, Jr., Easthampton, Mass.

[73] Assignee: McCormick & Company, Inc., Hunt Valley, Md.

[21] Appl. No.: 427,993

[22] Filed: Oct. 27, 1989

Related U.S. Application Data

[63] Continuation of Ser. No. 181,070, Apr. 13, 1988, abandoned.

[51] Int. Cl.[5] ..... B65D 47/28; B65D 55/08

[52] U.S. Cl. ..... 222/521; 222/540

[58] Field of Search ..... 222/519, 520, 521, 525, 222/540

[56] References Cited

U.S. PATENT DOCUMENTS

| | | | |
|---|---|---|---|
| 1,491,529 | 4/1924 | Haeseler | 222/540 X |
| 1,948,227 | 2/1934 | Rechten | 222/540 X |
| 2,537,226 | 1/1951 | Lindsey | 222/540 X |
| 3,010,619 | 11/1961 | Gronemeyer et al. . | |
| 3,136,457 | 6/1964 | Via, Sr. | 222/540 X |
| 3,175,741 | 3/1965 | Porter | 222/521 |
| 3,204,836 | 9/1965 | Joffe . | |
| 3,216,630 | 11/1965 | Stull | 222/499 |
| 3,319,843 | 5/1967 | Stull . | |
| 3,370,764 | 2/1968 | Stull | 222/499 |
| 3,406,880 | 10/1968 | Stull . | |
| 3,407,967 | 10/1968 | Stull | 222/521 X |
| 3,583,846 | 6/1971 | Kimball et al. . | |
| 3,834,596 | 9/1974 | Brady et al. . | |
| 4,000,839 | 1/1977 | Tecco et al. | 222/540 |
| 4,015,631 | 4/1977 | Hayes . | |
| 4,065,037 | 12/1977 | Haller . | |
| 4,261,487 | 4/1981 | Seager . | |
| 4,314,657 | 2/1982 | Perakis et al. . | |
| 4,358,031 | 11/1982 | Lohrman | 222/521 X |
| 4,383,623 | 5/1983 | Page, III | 222/521 |
| 4,470,521 | 9/1984 | Scammell | 222/107 |
| 4,474,314 | 10/1984 | Roggenburg, Jr. | 222/521 X |
| 4,477,002 | 10/1984 | Stull . | |
| 4,506,809 | 3/1985 | Corsette | 222/520 X |
| 4,583,667 | 4/1986 | Fishman et al. . | |
| 4,690,304 | 9/1987 | Morel . | |

FOREIGN PATENT DOCUMENTS

| | | | |
|---|---|---|---|
| 258191 | 11/1967 | Austria | 222/521 |
| 2803353 | 8/1979 | Fed. Rep. of Germany | 222/520 |
| 1526291 | 5/1968 | France | 222/521 |
| 291075 | 5/1953 | Switzerland . | |

*Primary Examiner*—Kevin P. Shaver
*Assistant Examiner*—Kenneth R. DeRosa
*Attorney, Agent, or Firm*—Cushman, Darby & Cushman

[57] ABSTRACT

A two-piece tubed product dispensing closure wherein the cap member has a recessed top surface such that the connected tube can be stored in an upright position resting on the end closure. The closure includes a steep pitch double thread on the tube end in combination with a steep pitch single thread in the cap to create rapid opening and closing of the closure with good cap control.

3 Claims, 3 Drawing Sheets

DISPENSING CLOSURE HAVING AN INTERIOR SEALING SLEEVE, A THREADED SLEEVE ENGAGING A THREADED TUBE, AND STOP BLOCKS LIMITING TWISTING OF THE CLOSURE CAP

This is a continuation of application No. 07/181,070, filed Apr. 13, 1988, now abandoned.

FIELD OF THE INVENTION

This invention relates to a tube closure device for dispensing products contained within the tube. More particularly, this invention relates to a dispensing closure device which has a recessed upper surface allowing the tube to be stored in an upright position on top of the closure member.

BACKGROUND OF THE INVENTION

Several prior art dispensing closures have been proposed for containers. While many exhibit simplicity and convenience of construction, none lend themselves to ease of storing the tubed product during non-use in an upright position. In all instances, the tube must be laid on its side as opposed to being stood in an upright matter on top of the closure device. Examples of such closure devices are contained in the following U.S. patents to Stull: U.S. Pat. Nos. 3,216,630, 3,319,843, 3,370,764, 3,406,880, and 3,407,967.

In each of the cited references to Stull, the closure generally comprises a two-piece cap system. A first inner cap portion which includes a valve body and an outer threaded portion, and a second outer cap portion which includes an inner threaded portion, to engage the outer thread portion of the inner cap, and a valve stem engaging hole. The outer portion of the two-piece cap system threads over the inner portion, and by twisting the outer portion relative to the inner portion, the valve is thereby opened and closed. The twisting results in relative displacement between the outer and inner portions along the valve stem, thereby dislodging the valve stem from the hole in the outer cap member.

Another prior art dispensing closure is disclosed in U.S. Pat. No. 4,383,623 to Page. The Page closure is similar to the Stull closures in that it also has a rotating outer cap member which displaces relative to an inner stationery valve member thereby opening and closing the closure. In further similarity to the Stull closures, the Page device does not allow storage of the connected tube, and enclosed product, in an upright position on top of the closure assembly.

The present invention proposes a two-piece dispensing closure which has a recessed top surface on the outer cap assembly. This recessed upper surface allows the closure and the attached tube to be stored in an upright position with the tube arranged on top of the closure device. By storing the tube and enclosed product in this manner, the viscous tubed product is drawn by gravity to the end of the tube nearest the closure so that the product is readily dispensed immediately upon opening of the closure. Further, when the product has been dispensed to where the tube is almost empty, storage in an upright position allows the product to be drawn completely from the tube so as to permit dispensing in a normal manner.

The present invention also proposes a particular interrelationship between the threads of the respective cap and tube end. This relationship allows for maximum axial displacement between the cap and tube for minimal associated rotational displacement therebetween.

SUMMARY OF THE INVENTION

A closure assembly according to the present invention is made up of two major portions, a tube end portion, and a cap assembly. The cap assembly and tube end portion interrelate to form a two-piece dispensing closure assembly. The cap assembly is formed with an end wall that is concave to a degree sufficient to provide clearance for the protruding valve stem and exterior valve body.

In this manner, a dispensing closure according to the present invention allows disposition of the closure and attached tube in an upright position wherein the viscous tubed product is arranged on top of and is drawn towards the closure assembly.

Another object of this invention is to provide a dispensing closure wherein the amount of relative rotational displacement between the cap and tube and member is comparatively small for the corresponding degree of opening between the cap and tube end member.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various Figures.

DETAILED DESCRIPTION OF THE PREFERRED EMBODIMENT

Figure 1:
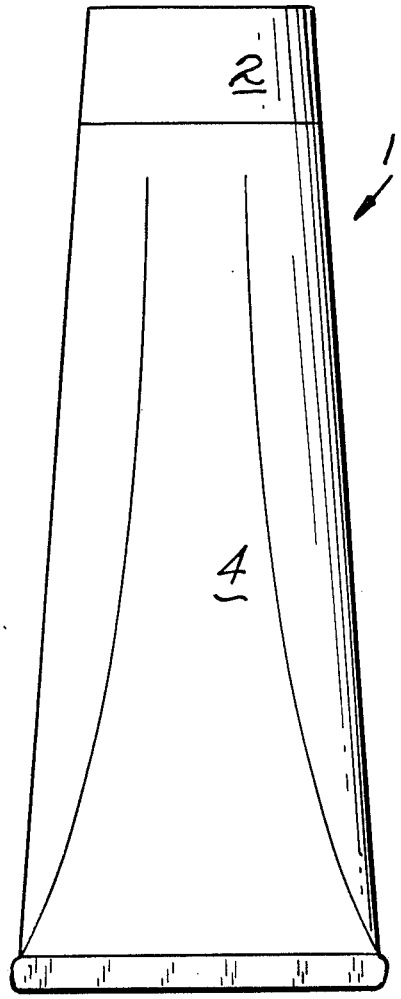
FIG. 1 is a side view of a tube equipped with a dispensing closure according to the present invention.
Figure 3:
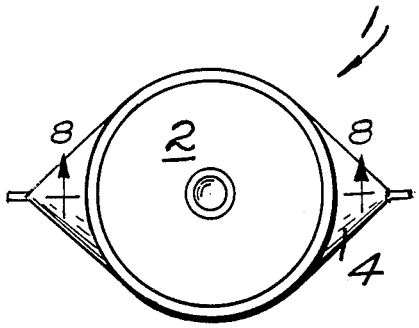
FIG. 3 is an end view of a tube equipped with a dispensing closure according to the present invention, shown in an open position.
Figure 2:
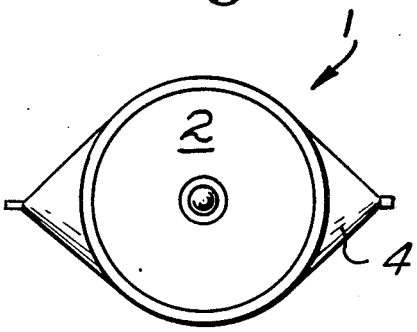
FIG. 2 is an end view of a tube equipped with a dispensing closure according to the present invention, shown in a closed position.
Figure 5:
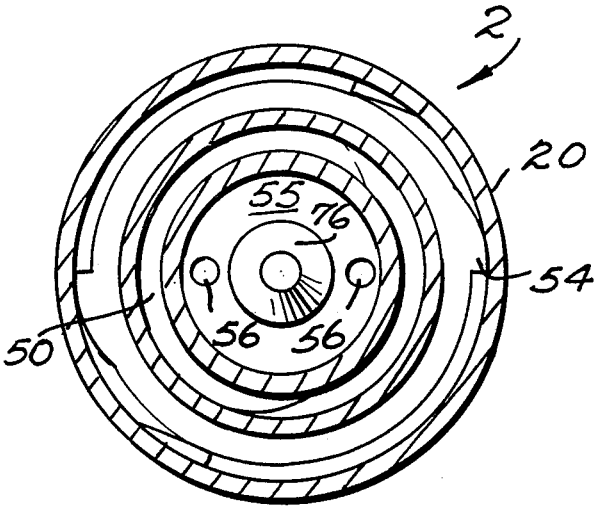
FIG. 5 is a top sectional view of the closure shown along line 5—5 of FIG. 7.
Figure 6:
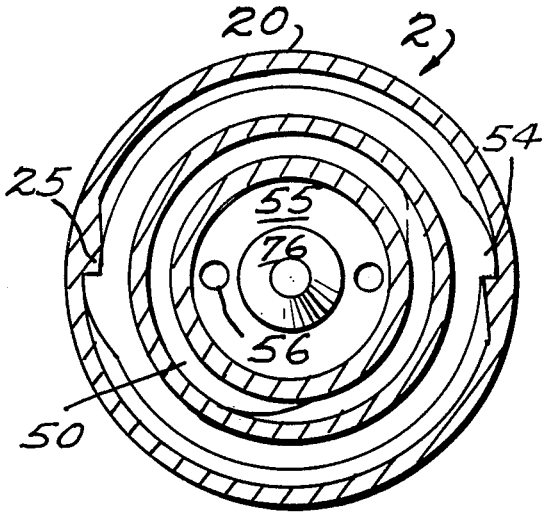
FIG. 6 is a top sectional view of the closure shown along line 6—6 of FIG. 8.

FIG. 1 illustrates the physical arrangement of a tubed product equipped with a dispensing closure according to the present invention. The combination tube and closure 1 comprises a closure assembly 2 located at one end of tube 4. Similarly, FIGS. 2 and 3 illustrate end views of the closure and tube assembly in closed and open positions, respectively.

Figure 4:
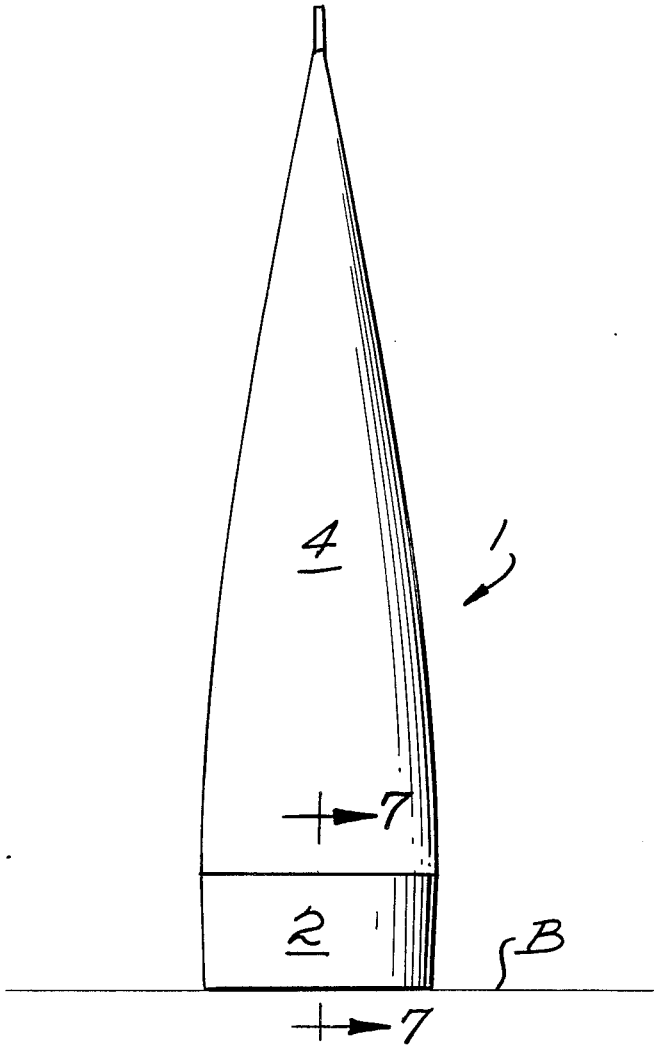
FIG. 4 is a side view of the dispensing closure shown in FIG. 1, rotated 90°, and positioned in an upright position on a surface.

FIG. 4 illustrates the preferred method of storage of the tube and closure combination 1. Conveniently the tubed product may be stored in an upright position on surface B wherein the closure assembly 2 provides stable support for tube 4.

With reference to drawing FIGS. 5–13, the closure assembly will now be described. The closure assembly comprises the following major portions: a cap assembly 20 and a tube end portion 50. The cap assembly 20 and tube end portion 50 interact to form a two-piece dispensing closure assembly.

Cap assembly 20 is made up of cap top portion 30 and side portion 24. Top portion 30 is characterized by an inwardly concave upper surface 32. Located on surface 32 is an upstanding exterior valve body 34. Valve body 34 interacts with valve stem 76 to seal and unseal the closure member.

Top portion 30 also has two downwardly depending sleeves 39 and 31 located on its underside. Inner cap sleeve 39 in combination with the bottom surface of the inwardly concave surface 32 form the upper limits of cap chamber A. Inner cap sleeve 39 sealingly engages, in all relative positions of the cap and tube end portion, upstanding sleeve member 60 of the tube end portion 50. This sealing engagement between sleeves 39 and 60 prevents any product from escaping from the tube except when desired through exterior valve body 34 when the closure assembly is in the fully open position.

The second sleeve which depends from the cap top portion 30 is outer cap sleeve 31. The inner surface of the outer cap sleeve 31 has a threaded portion 35 which engages the threaded portion 62 of upstanding sleeve member 60. The interrelated threads provide relative axial displacement between the cap and tube end portion when the cap is twisted.

Side portion 24 has a peripheral notch 25 included along its lower most portion. Notch 25 engages stop block 54 located on a peripheral portion of tube end portion 50 when the fully open position of the closure is achieved. In this manner, sturdy blocking members of the cap and tube end portion engage to prevent overloosening of the cap from the tube end portion and thus preserve the shape of the cap and tube end portion in undistorted form.

Cap upper portion 30 is connected to the cap side wall 24 at rim 38. The concave upper surface 32 of cap top portion 30 dips sufficiently to allow cap rim 38 to protrude beyond valve stem 76 and upstanding exterior valve body 34 so as to allow clearance between a supporting surface B and the protruding valve members.

Tube end portion 50 is made up of tube end side walls 40, end wall 52, upstanding sleeve member 60 and valve stem 70. When the cap is fully tightened onto the tube end portion, the lower edge of cap side portion 24 abuts against a protruding shoulder 41 located between side walls 40 and the tube 4.

End wall 52 has upstanding sleeve member 60 connected thereto. Sleeve member 60 interacts with the two downwardly depending sleeves 39 and 31 of cap top portion 30. The threaded portion 35 of the outer cap sleeve 31 engages the threaded portion 62 of upstanding sleeve 60. The respective threaded portion 62 and threaded portion 35 cooperate such that twisting of cap assembly 20 relative to tube end portion 50 results in displacement of the cap assembly either away from or towards the tube end portion for a given relative rotation of the cap and tube end portions.

The tube incorporates two threads 62 that start 180 degrees apart. The pitch on both threads is 0.250. The thread profile on both the cap and tube is that of a standard 0.125 pitch, 24 mm thread. With the threads starting 180 degrees apart, the spacing between them, when they are parallel to one another, is the same as it would be if they were designed for a standard 0.125 pitch tube/cap engagement. This condition on the tube contains the thread on the cap and guides it through the raising and lowering of the cap. The tube and cap assembly of the present invention therefore benefits not only from the quick rise/fall of the 0.250 pitch thread, but also maintains control of the cap through the thread engagement. The 0.250 pitch thread on both the cap and tube allow an operator to "raise" the cap's exterior valve body (34) off the tube valve stem (76) the required amount with only one-quarter to one-third of a revolution of the cap.

End wall 52 includes a passage containing surface 55. Passage containing surface 55 has located therein passages 56 which allow movement of the product through chamber A and past the valve assembly. Passage containing surface 55 supports valve stem 76. Valve stem 76 comprises a main body portion 72, tapered sealing surfaces 74, and a valve stem tip portion. The valve stem 76, and passage containing surface 55 are molded as integral parts of tube end portion 50.

Figure 7:
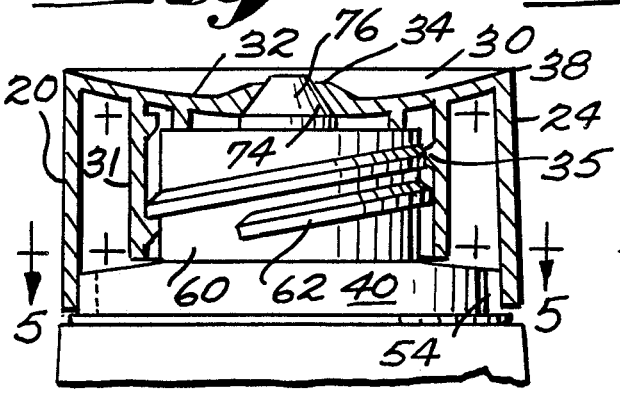
FIG. 7 is a cross-sectional view of a dispensing closure according to the present invention, along section 7—7 of FIG. 4, and shown in a closed position.
Figure 8:
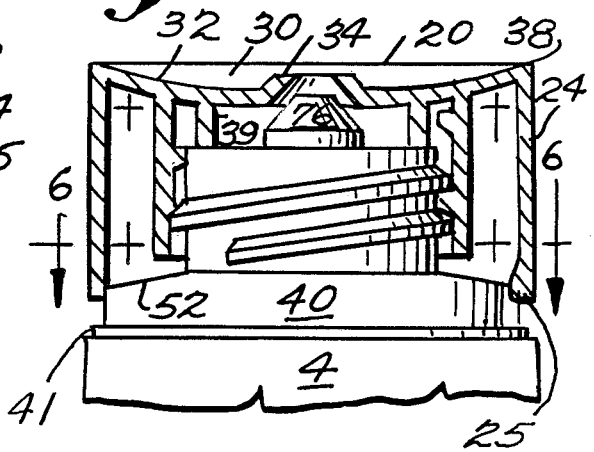
FIG. 8 is a cross-sectional view of a dispensing closure according to the present invention, along section 8—8 of FIG. 3, and shown in an open position.
Figure 9:
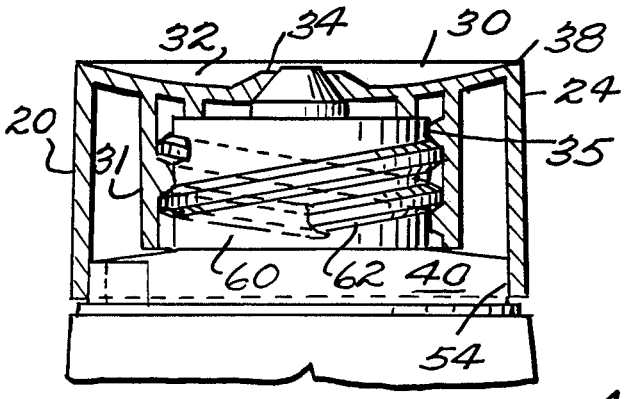
FIG. 9 is a partial-sectional view of a dispensing closure according to the present invention rotated 180° from the section of FIG. 7, showing the closure in the closed position.
Figure 10:
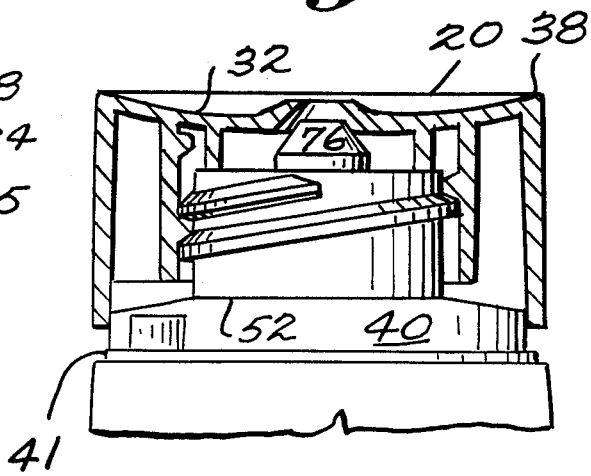
FIG. 10 is a partial section of a dispensing closure according to the present invention.
Figure 11:
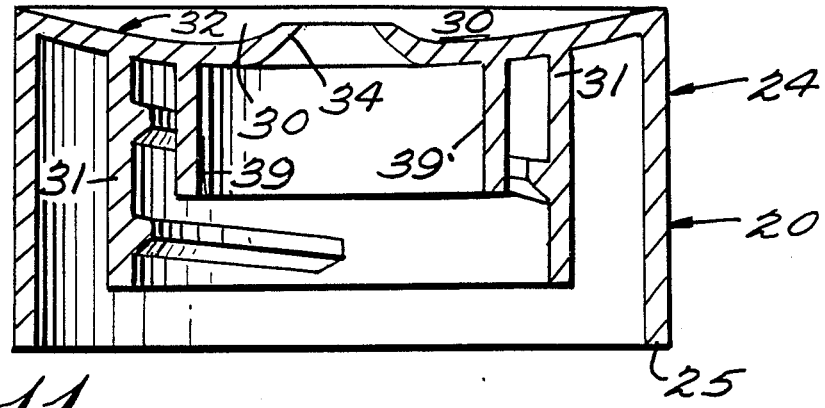
FIG. 11 is a section of a closure cap according to the present invention.
Figure 12:
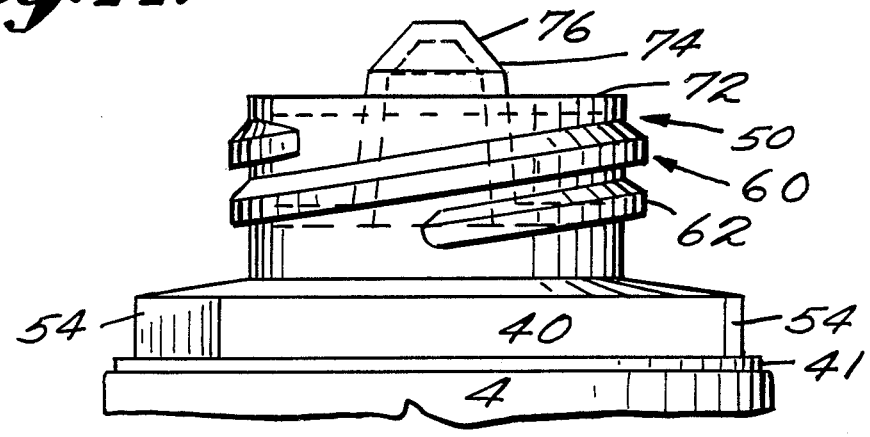
FIG. 12 is a side view of a tube end according to the present invention with the cap removed.
Figure 13:
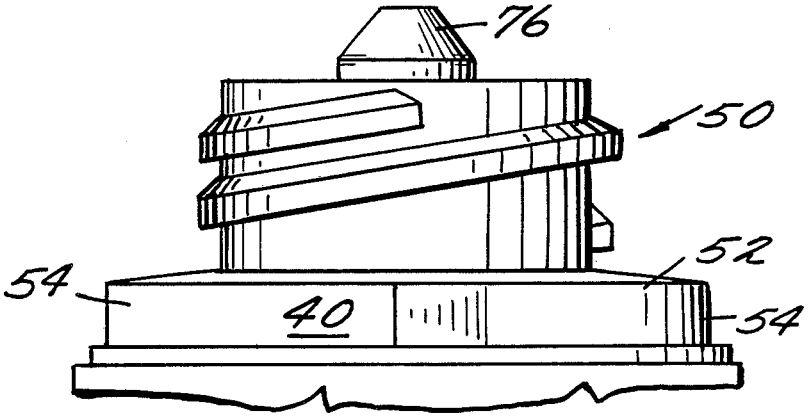
FIG. 13 is a side view of a tube end according to the present invention with the cap removed.

In the closed position (as shown in FIGS. 7 and 9) tapered sealing surfaces 74, of valve stem 76, interact with the inner surfaces of the cap valve body 34 to stop the movement of product through cap chamber A. However, in the open position (as shown in FIGS. 8 and 10) surfaces 74 and 34 are no longer in contact and thus tubed product may pass through chamber A and past the open valve.

FIG. 4 illustrates the closure assembly oriented in an upright position on surface B. As shown, cap rim 38 protrudes sufficiently to provide clearance between surface B and valve stem 76 and upstanding exterior valve body 34. In this manner, a tube equipped with a dispensing closure according to the present invention is easily stored in a non-use upright position for ready and complete dispensing of the contained product.

The closure assembly 2 may be injection molded from any suitable plastic molding material. Preferably, the separate cap assembly and tube end portion, which together make up the closure assembly, are each constructed as single integrally molded plastic pieces.

While the present invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What the claim is:

1. A dispensing device for dispensing a tubed product, comprising:

a cap having a cup shape with a concave end wall and an integral peripherally located side wall, said concave end wall including a centrally located exterior valve element, said cap also having a first interior sleeve, with a single continuous thread located on an interior surface thereof, depending from said concave end wall and a second sleeve located interiorly of said first interior sleeve, said second sleeve having a smaller axial dimension than said first sleeve; and a tube end portion having an end wall with passages located therein and an upstanding exteriorly double threaded sleeve formed integrally therewith, said double threaded sleeve comprising a tubular member including an internal cylindrical surface having a selected axial extent, said tube end wall also having an upstanding centrally located tapered valve stem extending therefrom, said second sleeve of said cap comprising a tubular surface portion with said tubular surface portion being dimensioned to sealingly engage said internal cylindrical surface of said double threaded sleeve of said tube end portion over a substantial portion of said selected axial extent for all positions of said cap relative to said tube end portion, said tube end portion being dimensioned to telescopically fit within the cap, said cap interior sleeve thread and said tube end portion upstanding double threaded sleeve portion cooperating in a manner so as to provide relative axial displacement between said cap and said tube end portion when said cap is twisted relative to said tube end portion, said valve stem and said valve element cooperating to seal and unseal said dispensing closure upon the occurrence of axial displacement therebetween, the respective limits of axial displacement being a closed and a most open position for the dispensing closure; said tube end portion further including a shoulder and a side wall extending axially from said shoulder with said side wall of said tube end portion having an axial dimension less than that of said double threaded sleeve, said side wall of said tube end portion having at least one first stop block means disposed thereon and said side wall of said cap having at least one second stop block means formed thereon for cooperation with said first stop block means, the two stop blocks means limiting the twisting of said cap relative to said tube end portion between said closed to said most open positions for the dispensing device, said shoulder of said tube end portion cooperating with a bottom edge portion of said side wall of said cap to limit twisting of said cap relative to said tube end portion from said most open to said closed position, said thread of said first interior sleeve reminding in contact with said double threaded sleeve of said tube end portion for all positions of said cap and tube end portion;

said concave end wall of said cap being sufficiently concave such that a peripheral rim of said cap extends axially beyond said exterior valve element, the dispensing device being capable of being stored on said end wall of said cap so that the tubed product will be pulled by gravity toward said end wall of said tube when it is so stored.

2. A dispensing closure as in claim 1, wherein:

said tube end portion, said end wall, upstanding sleeve and valve stem are a single integral molded peice.

3. A dispensing closure as in claim 1, wherein;

said cap assembly is injection molded and tube end portion is made of compression molded plastic.

* * * * *